US006776411B2

(12) United States Patent
Klenk

(10) Patent No.: US 6,776,411 B2
(45) Date of Patent: Aug. 17, 2004

(54) DELIVERY FOR A MACHINE FOR PROCESSING FLAT PRINTING MATERIALS WITH ADJUSTABLE PILE UNDERLAY INSERTER CONVEYOR

(75) Inventor: Rainer Klenk, St. Leon-Rot (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 59 days.

(21) Appl. No.: 09/952,739

(22) Filed: Sep. 14, 2001

(65) Prior Publication Data

US 2002/0084577 A1 Jul. 4, 2002

(30) Foreign Application Priority Data

Sep. 14, 2000 (DE) ..... 100 45 883

(51) Int. Cl.[7] ..... B65H 31/10
(52) U.S. Cl. ..... 271/218
(58) Field of Search ..... 271/218, 217; 414/790.8, 790.1

(56) References Cited

U.S. PATENT DOCUMENTS

| | | | | | |
|---|---|---|---|---|---|
| RE23,641 | E | * | 4/1953 | Andren | 270/58.32 |
| 2,795,420 | A | * | 6/1957 | Rooney, Jr. | 271/218 |
| 3,233,891 | A | * | 2/1966 | Denton et al. | 271/189 |
| 3,410,424 | A | | 11/1968 | Rooney | |
| 3,881,722 | A | * | 5/1975 | Preuss | 271/218 |
| 4,269,556 | A | * | 5/1981 | Martini | 414/790.8 |
| 4,642,013 | A | * | 2/1987 | Mundus et al. | 414/790.7 |
| 5,074,743 | A | * | 12/1991 | Schaffner et al. | 414/790.8 |
| 5,240,369 | A | * | 8/1993 | Voss et al. | 414/790.8 |
| 5,322,272 | A | * | 6/1994 | Benz et al. | 271/218 |
| 5,349,904 | A | | 9/1994 | Ganter | |
| 5,433,429 | A | * | 7/1995 | Muller | 271/189 |
| 5,669,755 | A | | 9/1997 | Zahn | |
| 5,927,710 | A | * | 7/1999 | Pollich et al. | 271/218 |
| 6,000,691 | A | * | 12/1999 | Chmelar | 271/158 |
| 6,155,559 | A | | 12/2000 | Klenk | |
| 2002/0081188 | A1 | * | 6/2002 | Brown | 414/790.3 |
| 2002/0084578 | A1 | * | 7/2002 | Deutschle et al. | 271/215 |

FOREIGN PATENT DOCUMENTS

| | | | | |
|---|---|---|---|---|
| DE | 476374 | | 5/1929 | |
| DE | 2935710 | * | 3/1980 | 271/218 |
| DE | 3906649 | * | 10/1989 | 271/218 |
| DE | 42 21 928 A 1 | | 1/1994 | |
| DE | 43 44 361 A 1 | | 9/1994 | |
| DE | 196 12 294 A 1 | | 10/1997 | |
| DE | 199 28 252 A 1 | | 1/2000 | |
| DE | 199 56 100 A 1 | | 6/2000 | |
| EP | 0 459 145 A2 | | 12/1991 | |
| IT | 491937 | * | 3/1954 | 271/86 |
| JP | 62-12570 | * | 1/1987 | 271/218 |
| JP | 62 012 570 A | | 1/1987 | |
| JP | 63-295367 | * | 12/1988 | 271/218 |
| JP | 01 197 273 A | | 8/1989 | |

* cited by examiner

*Primary Examiner*—Donald P Walsh
*Assistant Examiner*—Daniel K Schlak
(74) *Attorney, Agent, or Firm*—Laurence A. Greenberg; Werner H. Stemer; Ralph E. Locher

(57) ABSTRACT

A delivery for a machine for processing flat printing materials includes a pile-forming station wherein sheets conveyed to the machine in a processing direction are piled, a make-ready station located upline of the pile-forming station in the processing direction and having an insertion opening formed in a side wall thereof for inserting a pile underlay into the make-ready station, and a conveyor by which a pile underlay inserted into the make-ready station is movable into the pile-forming station, a pile underlay carrier disposed in the make-ready station, the pile underlay carrier having a support adjustable between a first level and a second level lower than the first level, the support, at the first level thereof, accommodating the pile underlay inserted into the make-ready station, the support being adjustably movable in a direction to the second level for transferring the pile underlay to the conveyor; and a machine for processing flat printing materials including the delivery.

14 Claims, 5 Drawing Sheets

DELIVERY FOR A MACHINE FOR PROCESSING FLAT PRINTING MATERIALS WITH ADJUSTABLE PILE UNDERLAY INSERTER CONVEYOR

BACKGROUND OF THE INVENTION

Field of the Invention

The invention relates to a delivery for a machine for processing flat printing materials, especially a sheet-processing printing machine, having a pile-forming station wherein sheets conveyed to the machine in a processing direction are piled, a make-ready station located upline of the pile-forming station in the processing direction and having an insertion opening provided in a side wall for the insertion of a pile underlay into the make-ready station, and a conveyor by which the pile underlay inserted into the make-ready station is movable into the pile-forming station, and also relates to a machine for processing flat printing materials and equipped with the delivery, especially a printing machine.

A delivery of the foregoing general type is known heretofore from the published German Patent Document DE 196 12 294 C2. This discloses a conveyor by which pile underlays of different types can be transported from the aforementioned make-ready station into the aforementioned pile-forming station. To the extent that these pile underlays are in the form of a rake or a floating table, at least in the case of one and the same job to be processed by the machine, one and the same pile underlay may possibly be moved to and fro repeatedly between the make-ready station and the pile-forming station. However, the necessary changing of the delivery to a different pile underlay is required in any case at a job change and also only when, for example, in the case of a pile underlay provided in the form of a rake, this is unsuitable for the case of forming a pile on pallets not provided with grooves, in order to perform a pile change during production printing, so that the delivery has to be changed over to a pile underlay in the form of the aforementioned floating table. As a rule, therefore, a mounted pile underlay in the form of the rake or the floating table remains in use over a relatively long time period, because during a pile change using a rake or a floating table as a pile underlay forming an auxiliary pile carrier, the auxiliary pile carrier is always one and the same from case to case, depending upon the type of pallet used.

In the case of hurdle or rack formation, however, a further pile underlay in the form of a hurdle board is required for each partial pile to be formed.

Starting from a make-ready station, a device for mechanized loading of a pile-forming station with lost pile underlays, such as with hurdle boards, in particular, is disclosed by the published German Patent Document DE 43 44 361 C2. In the make-ready station disclosed therein, a plurality of pile underlays piled on one another is stored in a magazine, from which the respective lowermost underlay can be transported into the pile-forming station by a rake that is reciprocatingly movable between the make-ready station and the pile-forming station and is equipped with drivers or entrainers. Information relating to the filling of the magazine cannot be gathered from the aforementioned document. However, it is conceivable that, before the start of a print job, the magazine is filled up by inserting the pile underlays by hand. The disclosed device can therefore entirely be advantageously used for hurdle delivery, provided a print job does not exceed a specific edition size and therefore a specific number of requisite hurdle boards.

The delivery disclosed in the published German Patent Document DE 196 12 294 C2 mentioned at the introduction hereto is certainly, in principle, suitable for the case of exceeding a specific edition size. However, in this case, there remains the difficulty of introducing appropriate pile underlays into the make-ready station. For this purpose, the delivery disclosed in the last-cited document provides only a slot-like lateral opening in one side wall of the delivery, through which, respectively, a pile underlay in the form of a hurdle board is to be moved into the make-ready station and transferred to the conveyor which, in order to accommodate the pile underlay, has only frame arms which are arranged in the vicinity of a respective side wall. The introduction of a pile underlay through the aforementioned insertion opening therefore proves to be extremely difficult.

SUMMARY OF THE INVENTION

It is accordingly an object of the invention to provide a delivery for a machine for processing flat printing materials, namely a delivery of the general type described in the introduction hereto, so that the introduction of pile underlays into the make-ready station is made easier and can be performed in an extremely short time.

With the foregoing and other objects in view, there is provided, in accordance with one aspect of the invention, a delivery for a machine for processing flat printing materials, comprising a pile-forming station wherein sheets conveyed to the machine in a processing direction are piled, a make-ready station located upline of the pile-forming station in the processing direction and having an insertion opening formed in a side wall thereof for inserting a pile underlay into the make-ready station, and a conveyor by which a pile underlay inserted into the make-ready station is movable into the pile-forming station, a pile underlay carrier disposed in the make-ready station, the pile underlay carrier having a support adjustable between a first level and a second level lower than the first level, the support, at the first level thereof, accommodating the pile underlay inserted into the make-ready station, the support being adjustably movable in a direction to the second level for transferring the pile underlay to the conveyor.

In accordance with another feature of the invention, the support is formed with a table surface onto which the pile underlay is pushable.

In accordance with a further feature of the invention, the delivery includes a ramp for supporting the pile underlay during an initial phase of feeding thereof to the pile underlay carrier.

In accordance with an added feature of the invention, the delivery includes a further conveyor for feeding the pile underlay to the pile underlay carrier.

In accordance with an additional feature of the invention, the further conveyor includes a conveying roller connected to a drive.

In accordance with yet another feature of the invention, the drive is disposed within the conveying roller.

In accordance with yet a further feature of the invention, the delivery includes a roller arrangement disposed parallel to an axis of the conveying roller and biased in a direction towards the conveying roller.

In accordance with yet an added feature of the invention, the delivery includes a stop for restricting the pile underlays feedable to the pile underlay carrier to a predetermined maximum wall thickness.

In accordance with yet an additional feature of the invention, the delivery includes a sensor which, after the pile underlay has been inserted completely into the make-ready station, serves for generating a signal if an end of the pile underlay trailing with respect to the insertion direction deviates from a predetermined position.

In accordance with still another feature of the invention, the delivery includes a housing surrounding the insertion opening, the housing comprising the ramp and formed with an opening disposed upline of the insertion opening through which the pile underlay is to be pushed, and a flap which, in a first position thereof, closes the upline opening, and in a second position thereof, opens the upline opening, the flap being lockable in the first position thereof.

In accordance with still a further feature of the invention, the conveyor comprises a carriage, a frame is provided for carrying the pile underlay carrier and accommodating the carriage so that it is reciprocatingly movable between the make-ready station and the pile-forming station, and the ramp is suspended so as to be pivotably supported on the frame.

In accordance with another aspect of the invention, there is provided a machine for processing flat printing materials, including a delivery, comprising a pile-forming station wherein sheets conveyed to the machine in a processing direction are piled, a make-ready station located upline of the pile-forming station in the processing direction and having an insertion opening formed in a side wall thereof for inserting a pile underlay into the make-ready station, and a conveyor by which a pile underlay inserted into the make-ready station is movable into the pile-forming station, a pile underlay carrier disposed in the make-ready station, the pile underlay carrier having a support adjustable between a first level and a second level lower than the first level, the support, at the first level thereof, accommodating the pile underlay inserted into the make-ready station, the support being adjustably movable in a direction to the second level for transferring the pile underlay to the conveyor.

In accordance with a further aspect of the invention, there is provided a sheet-processing printing machine, including a delivery, comprising a pile-forming station wherein sheets conveyed to the printing machine in a processing direction are piled, a make-ready station located upline of the pile-forming station in the processing direction and having an insertion opening formed in a side wall thereof for inserting a pile underlay into the make-ready station, and a conveyor by which a pile underlay inserted into the make-ready station is movable into the pile-forming station, a pile underlay carrier disposed in the make-ready station, the pile underlay carrier having a support adjustable between a first level and a second level lower than the first level, the support, at the first level thereof, accommodating the pile underlay inserted into the make-ready station, the support being adjustably movable in a direction to the second level for transferring the pile underlay to the conveyor.

In accordance with a concomitant feature of the invention, the delivery is for a sheet-processing printing machine.

In order to achieve the aforementioned objects of the invention, in the make-ready station, there is thus arranged a pile underlay carrier having a support which can be adjusted between a first level and a second level lower than the first and which, at the first level thereof, accommodates the pile underlay inserted into the make-ready station and, by being adjusted in the direction of the second level, transfers the underlay to the conveyor.

In this configuration, a pile underlay, respectively, introduced into the make-ready station through the insertion opening can be pushed onto the pile underlay carrier, which then aligns the pile underlay in a necessary manner so that, after the pile underlay has been inserted, the latter is transferred to the conveyor by lowering the pile underlay carrier, after the pile underlay has been moved into a horizontal position by the aforementioned alignment.

Other features which are considered as characteristic for the invention are set forth in the appended claims.

Although the invention is illustrated and described herein as embodied in a delivery for a machine for processing flat printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
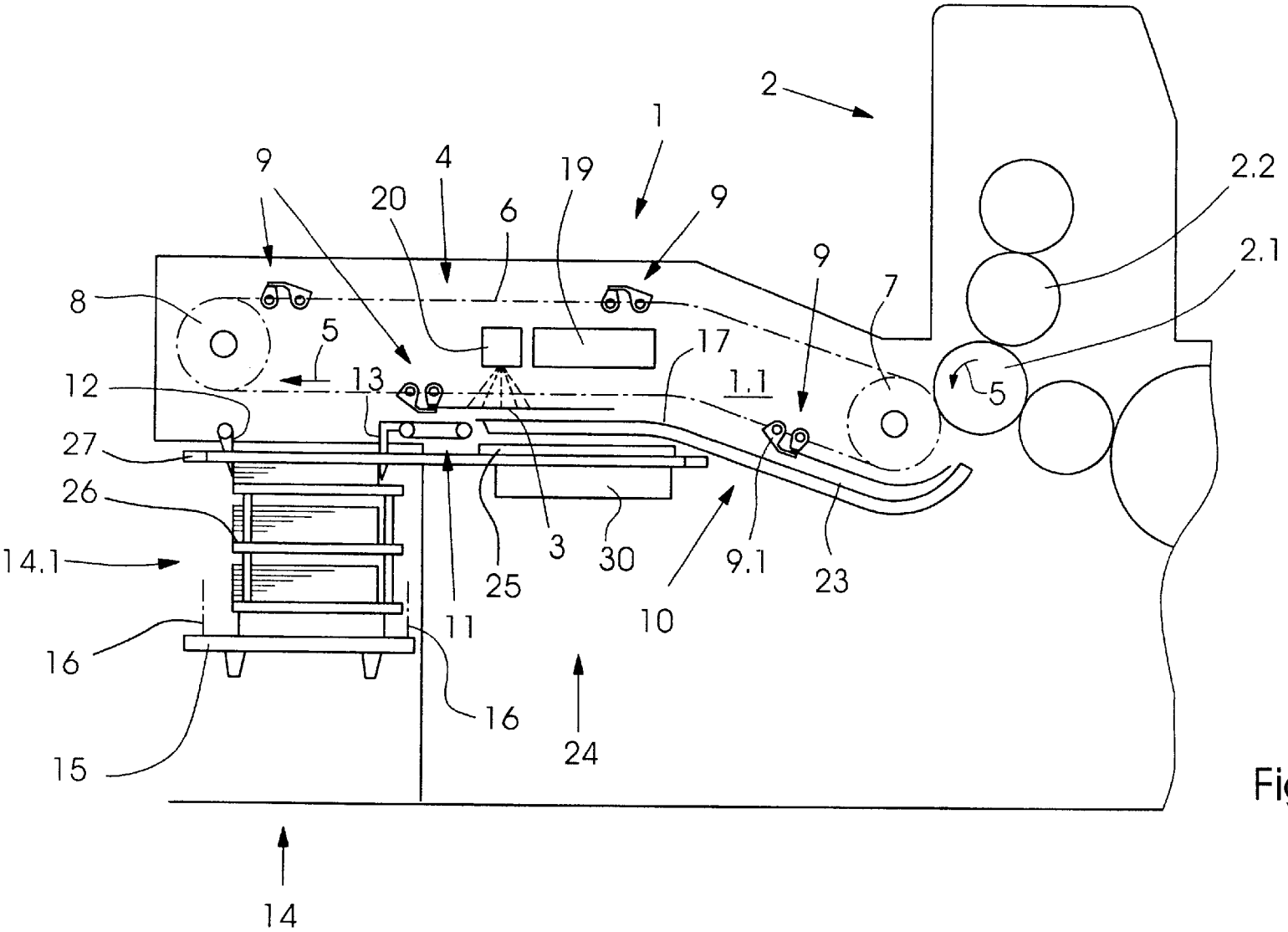
FIG. 1 is a fragmentary diagrammatic side elevational view of a sheet-processing printing machine, showing an end section thereof which includes the delivery according to the invention, having a pile-forming or stacking station and a make-ready station, the construction according to the invention being only roughly indicated therein.

Referring now to the drawings and, first, particularly to FIG. 1 thereof, there is shown therein part of a sheet-processing rotary printing machine including a delivery 1 following a last processing station of the machine. Such a processing station may be a printing unit or a post-treatment unit, such as a varnishing unit. In the example at hand, the last processing station is a printing unit 2 operating with the offset process and having an impression cylinder 2.1. The latter carries a respective sheet 3 in a processing direction represented by a directional arrow 5 through a printing nip between the impression cylinder 2.1 and a blanket cylinder 2.2 cooperating therewith, and subsequently transfers the sheet to a chain conveyor 4 while opening grippers arranged on the impression cylinder 2.1 and provided thereon for gripping the sheet 3 at a gripping edge at a leading end of the sheet 3. The chain conveyor 4 includes two conveyor chains 6, of which a respective chain 6 runs along a respective side wall of the chain delivery 4 during operation.

A respective conveyor chain 6 is wrapped or looped around a respective one of two synchronously driven drive sprockets 7 having axes of rotation which are aligned with one another and, in the example at hand, is respectively guided over a deflecting or reversing sprocket 8 located opposite the drive sprockets 7 and disposed downline therefrom, as viewed in the processing direction represented by the arrow 5. Between the two conveyor chains 6, there extend gripper systems 9 borne by the two chains 6 and having grippers 9.1, which pass through gaps between grippers arranged on the impression cylinder 2.1 and, in the process, accept a respective sheet 3 by gripping the aforementioned gripping edge at the leading end of the sheet 3 directly before the grippers arranged on the impression cylinder 2.1 open, transport the sheet over a sheet guiding device 10 to a sheet brake 11, and open thereat in order to transfer the sheet 3 to the sheet brake 11. The latter imparts to the sheet 3 a depositing speed which is reduced with respect to the processing speed and, after the sheet 3 has reached the depositing speed, in turn, releases the sheet 3, so that a respective, now retarded, sheet 3 finally encounters leading-edge stops 12 in a pile-forming or stacking station 14. The sheet 3 is aligned on the leading-edge stops 12 and on trailing-edge stops 13 located opposite the former and pivotable transversely with respect to the processing direction and, together with preceding and/or following sheets 3, forms a pile 14.1 which can be lowered, by a lifting mechanism, to an extent corresponding to that with which the pile 14.1 grows. Of the lifting mechanism, only a platform 15 carrying the pile 14.1, and lifting chains 16 carrying the platform 15 and represented in phantom are reproduced in FIG. 1.

Along the paths thereof between the drive sprockets 7, on the one hand, and the reversing sprockets 8, on the other hand, the conveyor chains 6 are guided by chain guide rails, which therefore determine the chain paths of the chain strands or runs. In the example at hand, the sheets 3 are transported by the lower chain strand in FIG. 1. The portion of the chain path through which the latter passes is followed alongside by a sheet guiding surface 17 formed on the sheet guide device 10 and facing towards the strand. Between the surface 17 and the sheet 3, respectively, guided thereover, a carrying air cushion is preferably formed during operation. For this purpose, the sheet guiding device 10 is equipped with blown-air or blast nozzles (not shown here) which open into the sheet guide surface 17.

In order to prevent mutual adhesion of the printed sheets 3 in the pile 14.1, a dryer 19 and a powdering device 20 are provided on the path of the sheets 3 from the drive sprockets 7 to the sheet brake 11.

In order to avoid excessive heating of the sheet guiding surface 17 by the dryer 19, a coolant circuit, which is represented in FIG. 1 by a coolant trough 23, is integrated into the sheet guiding device 10.

Figure 2:
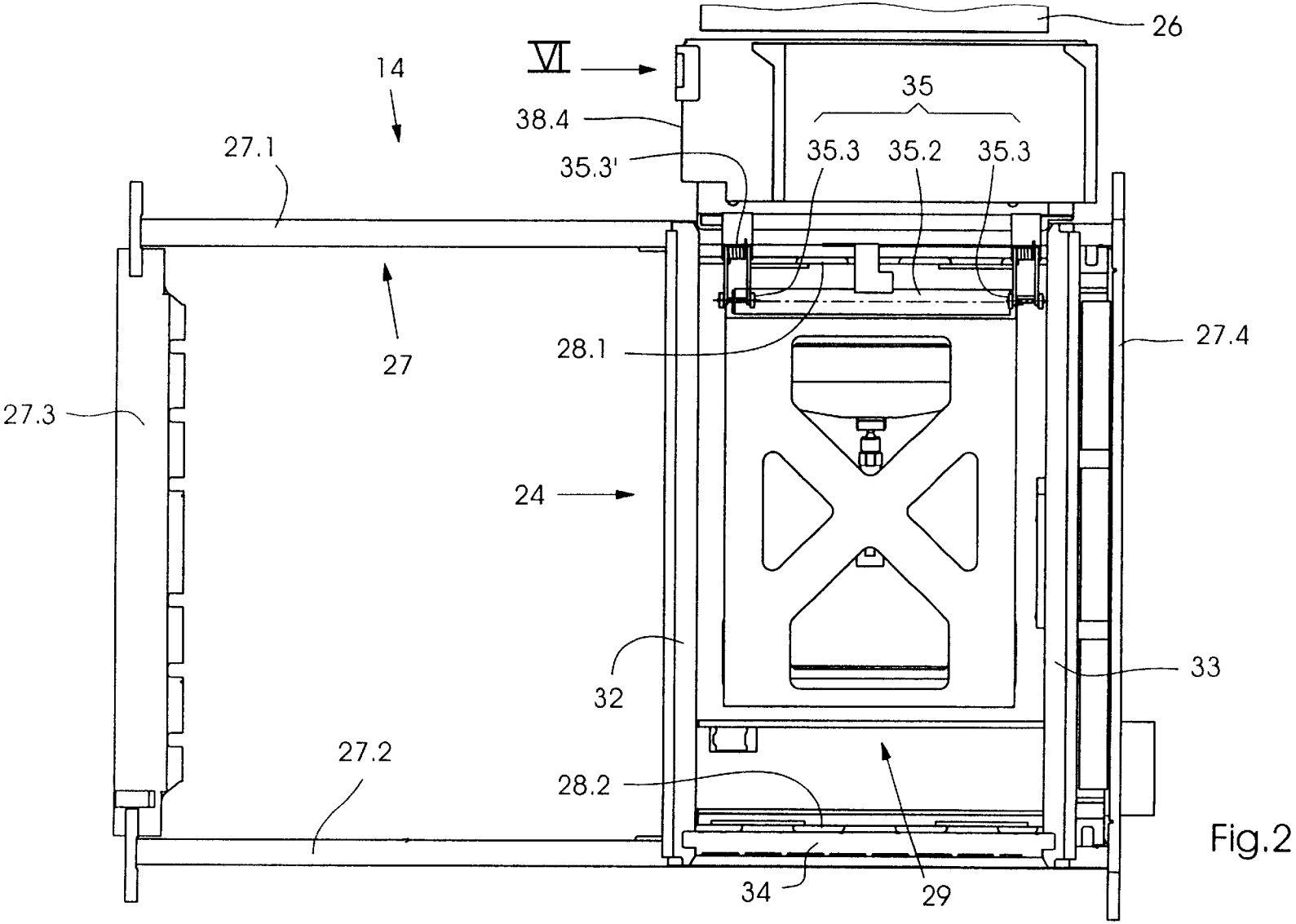
FIG. 2 is an enlarged fragmentary plan view of FIG. 1, showing the pile-forming station and the make-ready station, and omitting many of the components.

FIG. 2 shows, in a plan view, a make-ready station 24 which is adjacent to the pile forming station 14 and here is preferably provided upline of the pile-forming station 14, as viewed in the processing direction. In the vicinity of the pile-forming station, as can be seen in FIG. 1, in a side wall 1.1 of the delivery 1, there is provided an insertion opening 25 for inserting a pile underlay 26 into the make-ready station 24. Between the pile-forming station 14 and the make-ready station 24 there is a functional link via a conveyor, which will be explained hereinafter, by which the pile underlay 26 inserted into the make-ready station 24 can be moved into the pile forming station 14.

Figure 3:
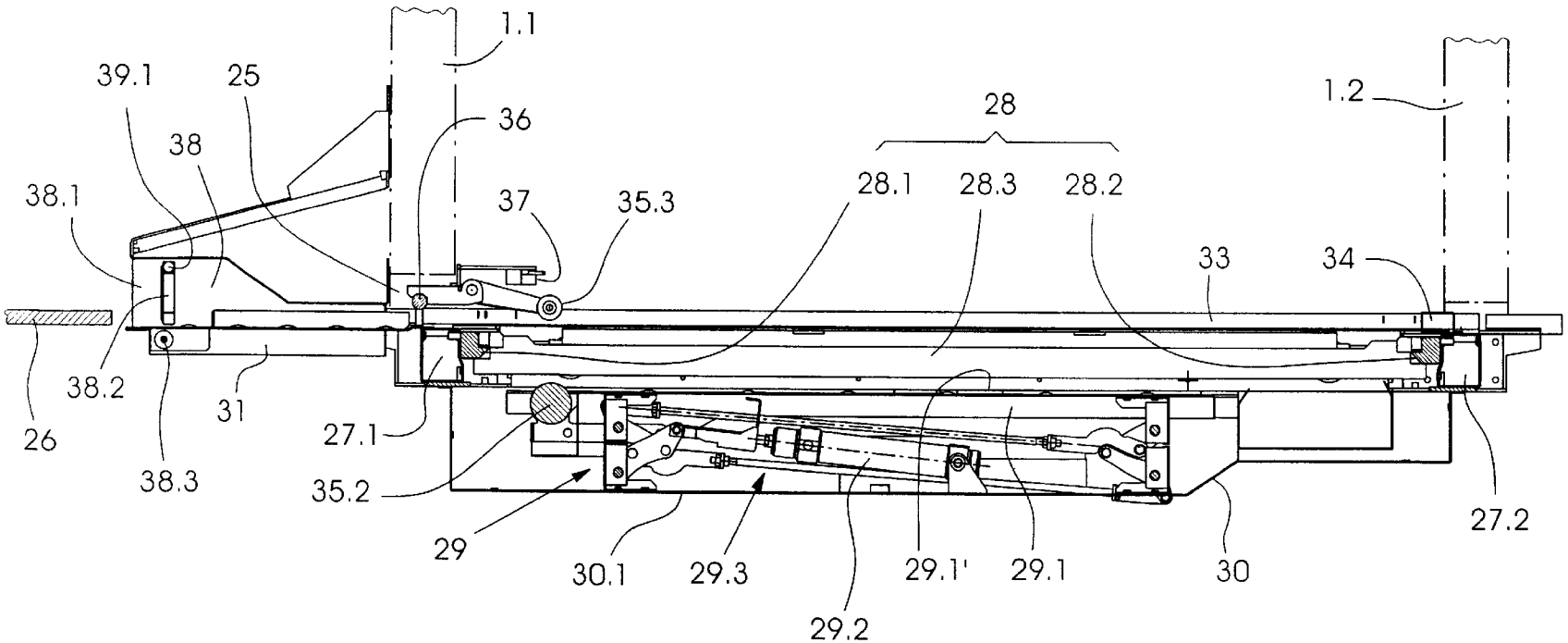
FIG. 3 is an enlarged cross-sectional view, taken transversely to the processing direction, of the make-ready station shown in FIG. 2.
Figure 5:
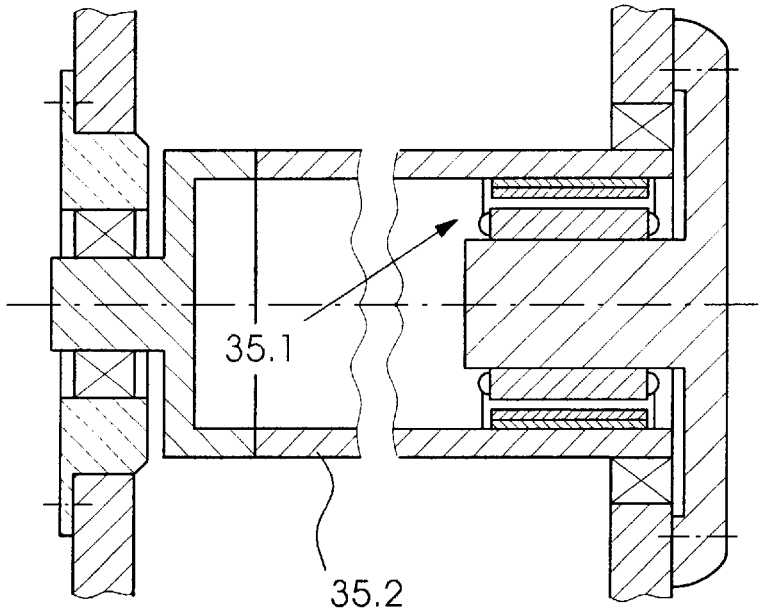
FIG. 5 is a sectional view of an exemplary embodiment of a conveying roller with a drive therefor arranged therewithin.

Above the pile-forming station 14 and the make-ready station 24, there extends a rectangular frame 27 which can be raised and lowered and has lateral frame arms 27.1 and 27.2 which are arranged in the region of a respective one of the side walls 1.1 and 1.2 and which, at the respective ends thereof, are joined to one another by respective crossmembers 27.3 and 27.4 (note FIG. 5). The frame arms 27.1 and 27.2 carry a U-shaped carriage 28 which is displaceable reciprocatingly along the arms 27.1 and 27.2 between the make-ready station 24 and the pile-forming station 14, is constructed for accommodating a pile underlay 26 and has arms 28.1 and 28.2 and a web 28.3 joining the arms 28.1 and 28.2, as can be seen in FIG. 3, and facing away from the pile-forming station 14. The frame arms 27.1 and 27.2 are constructed as hollow profiles, wherein linear drives are accommodated. The arms 28.1 and 28.2 of the carriage 28 are connected to the linear drives via drivers or entrainers which extend through the frame arms 27.1 and 27.2, and are arranged in the immediate vicinity of the frame arms 27.1 and 27.2.

The frame 27 with the linear drives integrated therein and the carriage 28 form a conveyor, by which a respective pile underlay 26 introduced into the make-ready station 24 and deposited on the carriage 28 can be moved into the pile-forming station 14.

In order to implement or realize the aforementioned conveyor in detail, recourse is preferably had to the configuration described in the published German Patent Document DE 196 12 294 C2 with reference to the auxiliary pile holding element therein and the auxiliary pile frame therein.

The carriage 28 is constructed for accommodating a respective pile underlay 26. To this end, as can be seen in FIG. 3, the arms 28.1 and 28.2 of the carriage 28 are respectively provided with an L-shaped cross section so that a respective L catches under a respective lateral edge region of a pile underlay 26 and forms a stop for a respective side end of the pile underlay 26, which is present here in the form of a hurdle board.

Arranged in the make-ready station 24 is a pile underlay carrier 29 having a support 29.1 that is adjustable between a first level and a second level lower than the first. The pile underlay carrier 29 is inserted, as can be seen in particular in FIG. 3, into a trough 30 which is arranged on the underside of the frame 27 and carried by the latter. The pile underlay carrier 29 is fixed to a base 30.1 of the trough 30, and is formed as a lifting table having a table surface 29.1' formed on the support 29.1, and a lifting mechanism 29.3 which carries the support 29.1 and can be actuated by an actuating cylinder 29.2 and has here the form of a link mechanism with a pivoting lever arrangement.

Figure 4:
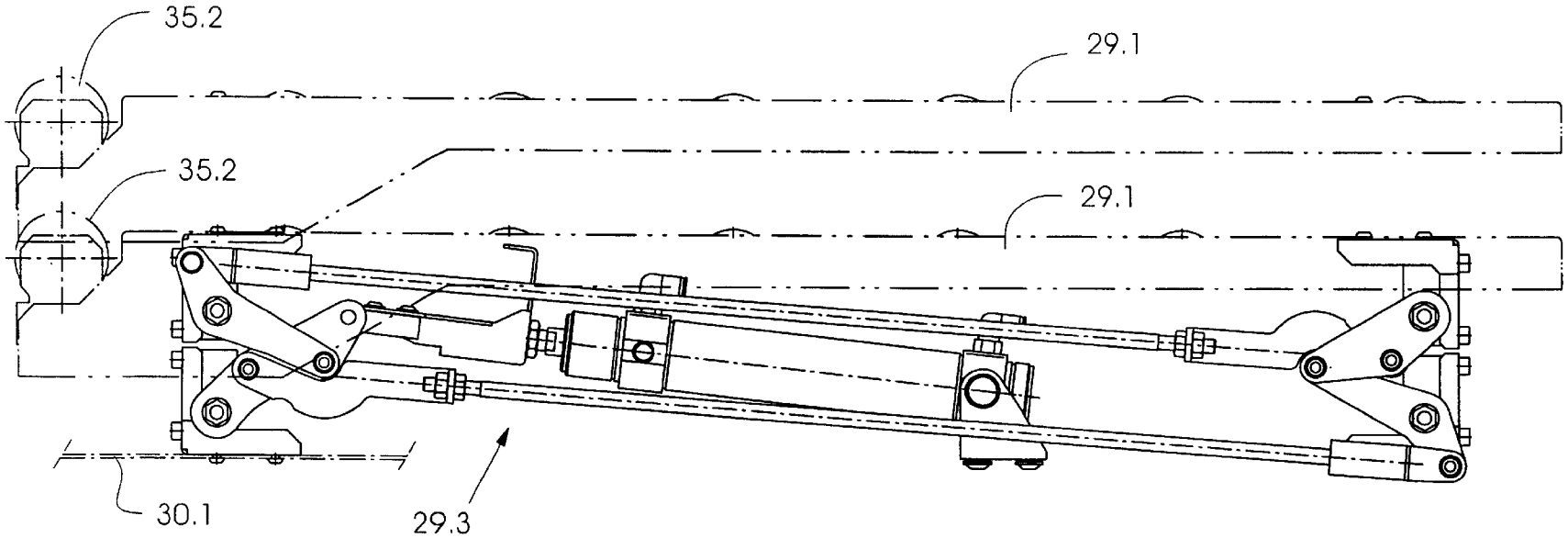
FIG. 4 is an enlarged fragmentary view of FIG. 3, showing a lifting mechanism by which a support for accommodating a pile underlay is adjustable between a first level and a lower second level, in a position of the lifting mechanism corresponding to the lower second level and in the form of a support carried by the lifting mechanism at height levels corresponding to the first and the second levels.

FIG. 4 shows the lifting table in a position removed from the delivery 1, the lifting mechanism 29.3 being reproduced in a position wherein the support 29.1 is located at the lower, second level thereof. The support 29.1 is shown both in the position thereof at the second level and in the position thereof at the higher, first level.

As is also apparent from FIG. 3, in an advantageous refinement, a ramp 31 is arranged on that side wall 1.1 of the delivery 1 which is formed with the insertion opening 25 mentioned hereinbefore. During an initial phase of the loading, which is manual here, of the make-ready station 24 with a pile underlay 26, the ramp 31 supports the latter and therefore provides further facilitation during the introduction of the underlay into the make-ready station 24.

At least during the action of inserting the pile underlay 26 through the insertion opening 25 into the make-ready station 24, the frame 27 which carries the trough 30 and, therefore, the pile underlay carrier 29 and, as mentioned hereinbefore, can be raised and lowered, assumes a height or level such that the pile underlay 26, which is being inserted into the make-ready station 24, can be transferred to the table surface 29.1' of the support 29.1 held at the first level by the lifting mechanism 29. In this case, the first level assumed by the support 29.1, or more precisely by the table surface 29.1' thereof, lies above the arms 28.1 and 28.2 of the carriage 28, and at least above those supporting surfaces which are formed by the L-shaped cross section of its arms 28.1 and 28.2, which are provided to catch under the lateral edge regions of the pile underlay 26. Otherwise, this first level is coordinated with the positions of the insertion opening 25 and of the ramp 31 so that unimpeded insertion of the pile underlay 26 into the make-ready station 24 is possible.

In order to position the pile underlay 26 in a correct position on the support 29.1 of the pile underlay carrier 29 during the transfer or the pile underlay 26 to the table surface 29.1' of the support 29.1, the guide rails 32 and 33 which guide the lateral end faces of the pile underlay 26 in the insertion direction, and a stop rail 34 are arranged on the frame 27.

By a return stroke of the piston rod of the actuating cylinder 29.2, which is extended in order to position the pile underlay 26 on the support 29.1, the support 29.1 is lowered from the first level thereof to the lower, second level thereof. This second level is defined so that the pile underlay 26 previously deposited on the table surface 29.1' is lifted off the table surface 29.1' by the arms 28.1 and 28.2 of the carriage 28 during the action of lowering the support 29.1, and is therefore transferred to the conveyor which includes the carriage 28.

Further facilitation results from a further conveyor 35 which is provided in a further refinement and by which the pile underlay 26 can be fed to the pile underlay carrier 29. This further conveyor 35 preferably includes a conveying roller 35.2 which is connected to a drive 35.1, which, as shown in the example of FIG. 5, is advantageously arranged within the conveying roller 35.2. With regard to this example, the conveying roller 35.2 constitutes an outer ring of an electric motor formed as an outer-ring rotor. The conveyor roller 35.2 is associated with the support 29.1 at the end of the latter facing the insertion opening 25 and projects slightly beyond the table surface 29.1' formed on the support 29.1, the height or level of the conveying roller 35.2 being adjustable within certain limits in an otherwise not specifically illustrated manner.

In order to ensure safe transport of the pile underlay 26 transferred to the further conveyor 35 by being pushed through the insertion opening 25, this conveyor 35 additionally preferably includes a roller arrangement 35.3, which is disposed parallel to the axis of the conveying roller 35.2 and, in the exemplary embodiment at hand, is biased in the direction of the latter by leg springs 35.3'. In the position of the support 29.1 at the first level thereof, a pile underlay 26 moved into the region of the conveying roller 35.2 is clamped between the conveying roller 35.2 and the roller arrangement 35.3 due to the aforementioned biasing of the latter.

In order to ensure loading which is correct with regard to the dimensioning of the pile underlays 26 of the make-ready station 24 and, therefore, of the pile-forming station 14 with pile underlays 26, a stop 36 is further provided, which restricts the maximum wall thickness of the pile underlays 26 which can be fed to the pile underlay carrier 29 to a predetermined amount.

In the example at hand, the stop 36 is provided in the form of a bar shown in cross section in FIG. 3, which extends along the insertion opening 25 transversely with respect to the insertion direction of the pile underlay 26.

According to a precaution which is likewise taken with regard to loading the make-ready station 24 with correctly dimensioned pile underlays 26, a sensor 37 shown in FIG. 3 is provided which, after the pile underlay 26 has been inserted completely into the make-ready station 24, generates a signal if an end of the pile underlay 26, which trails with respect to the insertion direction, deviates from a predetermined position.

In the position thereof wherein it rests on the stop 34 for the end of the pile underlay 26 which leads in the insertion direction, i.e., after the pile underlay 26 has been inserted completely into the make-ready station 24, the trailing end of a respective pile underlay 26 then assumes a predetermined position when it is accommodated in the L-shaped recess in the arm 28.1 of the carriage 28 as the support 29.1 is lowered. Otherwise, the lateral extent of the pile underlay 26 is too great or too small. By the signal generated by the sensor 37 in these cases, the aforementioned linear drives integrated in the frame 27 can then be blocked.

Taking into account the circumstance that the revolving gripper systems 9 pass through the make-ready station 24, in a further refinement, safety precautions are taken which prevent manual intervention in the insertion opening 25.

As is apparent in FIG. 3, these precautions preferably provide for a housing 38 that surrounds the insertion opening 25 to be arranged on the outer side of the side wall 1.1 having the insertion opening 25, the housing 38 including the ramp 31, an opening 38.1 arranged in front or upline of the insertion opening 25 for the pile underlay 26 to be pushed through, and a flap 38.2 which, in a first position thereof, closes the opening 38.1, in a second position, opens the opening 38.1 for the insertion of the pile underlay 26, and is lockable in the first position.

The housing 38 has a base in the form of the ramp 31 mentioned hereinbefore. This is suspended on an end of the housing 38 facing away from the side wall 1.1 so that it is pivotable on the housing about a horizontal shaft 38.3 and, by the end thereof facing towards the side wall 1.1, is supported on the frame 27. The ramp 31, therefore, if appropriate, matches different heights or levels of the frame 27 which, as mentioned hereinbefore, can be raised and lowered.

In FIG. 3, the flap 38.2 is illustrated in the first position thereof, closing the opening 38.1.

Figure 6:
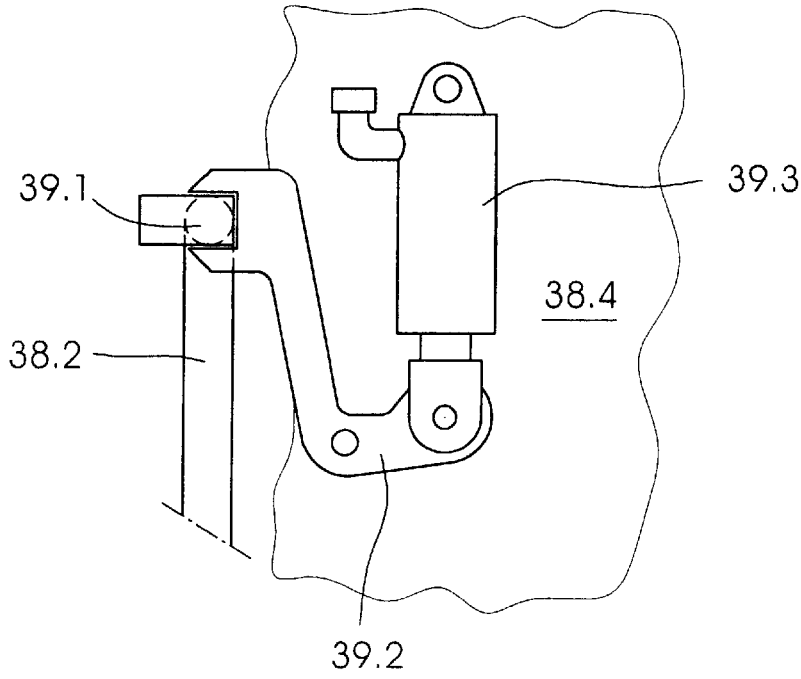
FIG. 6 is a fragmentary view of FIG. 2 as seen in the direction of the arrow VI in FIG. 2.

FIG. 6 shows the essential parts of an exemplary embodiment of an interlocking mechanism 39 for locking the flap 38.2 in the first position thereof wherein the opening 38.1 is closed. According to this exemplary embodiment, the interlocking mechanism 39 includes an end piece of rectangular cross-sectional construction placed in the vicinity of a side wall 38.4 of the housing 38, of a flap shaft 39.1 which is permanently connected to the flap 38.2 and arranged so that it can pivot on the housing 38, and a bolt 39.2, which is arranged so that it can pivot on the side wall 38.4, in the form of a two-armed lever having a mouth formed so as to engage formlockingly around the end piece of the flap shaft 39.1 at a first lever end, and an actuating cylinder 39.3 which engages on the second lever end, is attached to the side wall 38.4 and which, for example, can be loaded pneumatically, by which the mouth of the bolt 39.2 can be brought into and out of engagement with the aforementioned end piece of the flap shaft 39.1. When it is engaged, a pivoting movement of the flap 38.2 is blocked, due to the geometry of the end piece of the flap shaft 39.1 and of the mouth of the bolt 39.2. This situation is preferably present when the preferably single-acting actuating cylinder 39.3 is not subject to a load. In regard to the term "formlockingly", it is noted that a formlocking connection is one wherein a form-locking connection is one which connects two elements together due to the shape of the elements themselves, as opposed to a force-locking connection, which locks the elements together by force external to the elements.

I claim:

1. A delivery for a machine for processing flat printing materials, comprising:

a pile-forming station, sheets conveyed to the machine in a processing direction being piled in said pile-forming station;

a make-ready station located upline of said pile-forming station in said processing direction and having an insertion opening formed in a side wall thereof for inserting a pile underlay into said make-ready station;

a conveyor configured to move a pile underlay inserted into said make-ready station into said pile-forming station; and a pile underlay carrier disposed in said make-ready station, said pile underlay carrier having a support adjustable between a first level and a second level lower than said first level, said support, at said first level thereof, accommodating the pile underlay inserted into said make-ready station, said support being adjustably movable in a direction to said second level for transferring the pile underlay to said conveyor.

2. The delivery according to claim 1, wherein said support is formed with a table surface onto which the pile underlay is pushable.

3. The delivery according to claim 1, including a ramp for supporting the pile underlay during an initial phase of feeding thereof to said pile underlay carrier.

4. The delivery according to claim 3, including a housing surrounding said insertion opening, said housing comprising said ramp and formed with an opening disposed upline of said insertion opening through which the pile underlay is to be pushed, and a flap which, in a first position thereof, closes said upline opening, and in a second position thereof, opens said upline opening, said flap being lockable in said first position thereof.

5. The delivery according to claim 3, wherein said conveyor includes a carriage, a frame is provided for carrying said pile underlay carrier and accommodating said carriage so that it is reciprocatingly movable between said make-ready station and said pile-forming station, and said ramp is suspended so as to be pivotably supported on said frame.

6. The delivery according to claim 1, including a further conveyor for feeding the pile underlay to said pile underlay carrier.

7. The delivery according to claim 6, wherein said further conveyor includes a conveying roller connected to a drive.

8. The delivery according to claim 7, wherein said drive is disposed within said conveying roller.

9. The delivery according to claim 7, including a roller arrangement disposed parallel to an axis of said conveying roller and biased in a direction towards said conveying roller.

10. The delivery according to claim 1, including a stop for restricting the pile underlay feedable to said pile underlay carrier to a predetermined maximum wall thickness.

11. The delivery according to claim 1, including a sensor which, after the pile underlay has been inserted completely into said make-ready station, serves for generating a signal if an end of the pile underlay trailing with respect to the insertion direction deviates from a predetermined position.

12. The delivery according to claim 1, which is for a sheet-processing printing machine.

13. A machine for processing flat printing materials, comprising a delivery, including:

a pile-forming station, sheets conveyed to the machine in a processing direction being piled in said pile-forming station;

a make-ready station located upline of said pile-forming station in said processing direction and having an insertion opening formed in a side wall thereof for inserting a pile underlay into said make-ready station;

a conveyor configured to move a pile underlay inserted into said make-ready station into said pile-forming station; and a pile underlay carrier disposed in said make-ready station, said pile underlay carrier having a support adjustable between a first level and a second level lower than said first level, said support, at said first level thereof, accommodating the pile underlay inserted into said make-ready station, said support being adjustably movable in a direction to said second level for transferring the pile underlay to said conveyor.

14. A sheet-processing printing machine, including a delivery, comprising a delivery, including:

a pile-forming station, sheets conveyed to the machine in a processing direction being piled in said pile-forming station;

a make-ready station located upline of said pile-forming station in said processing direction and having an insertion opening formed in a side wall thereof for inserting a pile underlay into said make-ready station;

a conveyor configured to move a pile underlay inserted into said make-ready station into said pile-forming station; and a pile underlay carrier disposed in said make-ready station, said pile underlay carrier having a support adjustable between a first level and a second level lower than said first level, said support, at said first level thereof, accommodating the pile underlay inserted into said make-ready station, said support being adjustably movable in a direction to said second level for transferring the pile underlay to said conveyor.

* * * * *